US010982912B2

(12) United States Patent
Wang et al.

(10) Patent No.: US 10,982,912 B2
(45) Date of Patent: Apr. 20, 2021

(54) STREAMLINED WAVY FIN FOR FINNED TUBE HEAT EXCHANGER

(71) Applicant: Liangbi Wang, Lanzhou (CN)

(72) Inventors: Liangbi Wang, Lanzhou (CN); Kewei Song, Lanzhou (CN); Wanling Hu, Lanzhou (CN); Liangcheng Wang, Lanzhou (CN); Zhimin Lin, Lanzhou (CN); Limin Chang, Lanzhou (CN); Xiang Wu, Lanzhou (CN); Kun Zhang, Lanzhou (CN); Mei Su, Lanzhou (CN); Qiang Zhang, Lanzhou (CN); Peng Guo, Lanzhou (CN); Tianpeng Wang, Lanzhou (CN); Wenhe Zhou, Lanzhou (CN); Ye Wang, Lanzhou (CN); Yongheng Zhang, Lanzhou (CN); Xiaojian Wang, Lanzhou (CN); Song Liu, Lanzhou (CN)

(73) Assignee: Liangbi Wang, Lanzhou (CN)

( * ) Notice: Subject to any disclaimer, the term of this patent is extended or adjusted under 35 U.S.C. 154(b) by 0 days.

(21) Appl. No.: 15/104,926

(22) PCT Filed: Aug. 1, 2014

(86) PCT No.: PCT/CN2014/083506

§ 371 (c)(1),
(2) Date: Jun. 15, 2016

(87) PCT Pub. No.: WO2016/015324

PCT Pub. Date: Feb. 4, 2016

(65) Prior Publication Data

US 2016/0320147 A1 Nov. 3, 2016

Related U.S. Application Data

(63) Continuation of application No. PCT/CT2014/083506, filed on Aug. 1, 2014.

(51) Int. Cl.
*F28F 1/12* (2006.01)
*F28F 1/32* (2006.01)
(Continued)

(52) U.S. Cl.
CPC ..... *F28F 1/325* (2013.01); *F28F 1/32* (2013.01); *F28F 3/025* (2013.01); *F28F 13/02* (2013.01); *F28F 2250/02* (2013.01)

(58) Field of Classification Search
CPC .. F28F 19/00; F28F 19/006; F28F 1/24; F28F 1/30; F28F 1/325; F28F 1/32; F28F 3/025; F28F 2250/02; F28F 13/02
See application file for complete search history.

(56) References Cited

U.S. PATENT DOCUMENTS 1,920,313 A * 8/1933 Mautsch ..... F28D 1/053 165/151
3,515,207 A * 6/1970 Lu ..... F28F 1/12 165/151
(Continued)

FOREIGN PATENT DOCUMENTS

CN 103759566 4/2014
JP 59210298 A * 11/1984 ..... F28F 1/32
(Continued)

OTHER PUBLICATIONS

International Search Report of International application PCT/CN2014/083506, dated Apr. 27, 2015, 17 pages.

*Primary Examiner* — Travis C Ruby
*Assistant Examiner* — Harry E Arant
(74) *Attorney, Agent, or Firm* — Hamre, Schumann, Mueller & Larson, P.C.

(57) ABSTRACT

The present invention relates to a streamlined wavy fin for a finned tube heat exchanger, which comprises a fin body, an airflow inlet on one end of the fin body, an airflow outlet on
(Continued)

the other end of the fin body, mounting holes for mounting tubes on the fin body, and several convex/concave ripples consecutively formed from the airflow inlet to the airflow outlet on the fin body in an orientation of an airflow streamlines. A connection line of the wave crests of the same one convex ripple and a connection line of the wave troughs of the same one concave ripple neighboring the same one convex ripple are both streamlines. The present invention efficiently suppresses the flow separation downstream the circular tubes, and obviously reduces the pressure loss of airflow. And at the same time, the surface areas of the fins are increased, heat transfer resistance on the fin side is decreased, the streamlined fluid flow makes that it is not easy to producing a recirculation flow downstream the circular tubes, and heat transfer performance of the fins at the rear part of the tube bank may be obviously improved, which has better fluid flow and heat transfer performances, the fins is not easy to accumulate dust in use, and stability of heat transfer performance is maintained.

14 Claims, 4 Drawing Sheets

(51) Int. Cl.
*F28F 3/02* (2006.01)
*F28F 13/02* (2006.01)

(56) References Cited

U.S. PATENT DOCUMENTS 4,141,411 A * 2/1979 Kalnin ..... F25B 39/04 165/151
5,168,923 A * 12/1992 Sacks ..... B21D 53/04 165/151
2008/0035321 A1* 2/2008 Yoshioka ..... F24F 3/1411 165/201

FOREIGN PATENT DOCUMENTS

JP S59210296 11/1984
WO 2006004009 1/2006
WO 2007013623 2/2007

* cited by examiner

STREAMLINED WAVY FIN FOR FINNED TUBE HEAT EXCHANGER

TECHNICAL FIELD

The present invention relates to a fin for finned tube heat exchangers, in particular to a streamlined wavy fin for circular/elliptical finned tube heat exchangers.

BACKGROUND ART

It is usual that liquid working fluid flows in the tubes of a finned tube heat exchanger, and air flows outside of the tubes. In order to reduce heat transfer resistance on the air side, fins are mounted outside of the tubes to increase heat transfer area and then to decrease heat transfer resistance. As being limited by the volume and the economical efficiency of heat exchanger and the efficiency of the fins, the areas of the fins cannot be unlimitedly increased. In order to improve the heat transfer performance of the finned tube heat exchanger, increasing disturbance of fluid flow is an efficient measure for improving the heat transfer performance on the fin surfaces. The fins are usually manufactured into structural patterns to easily increase fluid disturbance, such as the louvered fin, the transversally wavy fin, the fin punched vortex generators, the intermittent annular groove fin, and the punched rhomboic formation, etc. Although the fins mentioned above may achieve heat transfer enhancement on the fin surfaces, the flow resistance increases. Furthermore, the louvered fin, the transversally wavy fin, the fin punched vortex generators, the intermittent annular groove fin, and the punched rhomboic formation fin, etc, can easily accumulate dust, thereby the heat transfer resistance of the fin increases, and the heat transfer performance of heat exchanger deteriorates.

In addition, for circular/elliptical finned tube heat exchanger, when air flows through the channels formed by the fin patterns mentioned above, the shapes of the streamlines of air flow are far from the streamlined shapes. Especially, when the flow velocity is larger, the flow separation occurs on the wall of the circular/elliptical tubes, and the flow recirculation regions will be formed downstream the circular/elliptical tubes, the flow separation will cause large pressure loss, and the heat transfer performance deteriorates, and hence, the heat transfer performance needs to be improved further.

In summary, the heat transfer enhancement technologies used by the existing fins for finned tube heat exchanger have not obviously changed the streamlines of the air flow in the channels formed by the circular/elliptical tube bank and the fins into streamlined shapes. Thus, the pressure loss of the air flow through the channels formed by the fins and the circular/elliptical tubes is large. Therefore, it is very important to further develop a fin pattern of better heat transfer performance, lower pressure loss and being not easy to accumulate dust.

SUMMARY OF THE INVENTION

An object of the present invention is to provide streamlined wavy fin for finned tube heat exchangers capable of suppressing flow separation of fluid flow, reducing pressure loss of fluid flow, improving heat transfer performance of fins and maintaining stability of their heat transfer performance.

In order to achieve the above object, the present invention provides streamlined wavy fin for finned tube heat exchangers, which includes a fin body, an airflow inlet on one end of the fin body, and an airflow outlet on the other end of the find body, and mounting holes for mounting tubes in the fin body, several convex ripples and concave ripples that are consecutively formed from the airflow inlet to the airflow outlet on the fin body in an orientation of the airflow streamlines, the connection line of the wave crests of the same one convex ripple and the connection line of the wave troughs of the same one concave ripple neighboring the convex ripple are both streamlines.

According to the streamlined wavy fin for finned tube heat exchangers as described above, the streamlines are such streamlines that on the central cross section of the channel formed by the tube-bank-plain fin corresponding to the fin body no recirculation flow appears in the region of the tube tails.

According to the streamlined wavy fin for finned tube heat exchangers as described above, the convex ripple and the concave ripple are provided within the boundaries of the ripple area set on the fin body, the boundaries of the ripple area are positioned at the upper and the lower sides of the mounting holes, are all the streamlines, and are determined according to their stream function values, and distance between the connection line of the wave crests of the same one convex ripple and the connection line of the wave troughs of the neighboring concave ripple or the number of the convex ripple and the concave ripple is determined according to the stream function values of the boundaries of the area.

According to the streamlined wavy fin for finned tube heat exchangers as described above, the cross sections of the convex ripple and the concave ripple are in shapes of demanded lines, such as folded line shapes, sinusoidal line shapes, parabolic line shapes, or arc line shapes.

According to the streamlined wavy fin for finned tube heat exchangers as described above, the amplitude of the convex ripple and the amplitude of the concave ripple have constant value.

According to the streamlined wavy fin for finned tube heat exchangers as described above, the amplitude of the convex ripple and the amplitude of the concave ripple are distributed in the longitudinal direction with a wavy profile.

According to the streamlined wavy fin for finned tube heat exchangers as described above, the amplitude of the convex ripple and the amplitude of the concave ripple are decreased in a zone where the airflow velocity is large, and are increased in a zone where the airflow velocity is small.

According to the streamlined wavy fin for finned tube heat exchangers as described above, the amplitude of the convex ripple and the amplitude of the concave ripple are the same and uniformly distributed along the transversal direction.

According to the streamlined wavy fin for finned tube heat exchangers as described above, the amplitude of the convex ripple and the amplitude of the concave ripple are not the same and no uniformly distributed along the transversal direction.

According to the streamlined wavy fin for finned tube heat exchangers as described above, the amplitude of the convex ripple and the amplitude of the concave ripple are respectively increased at the position away from the mounting holes, and decreased at the position near the mounting holes.

According to the streamlined wavy fin for finned tube heat exchangers as described above, the convex ripple and the concave ripple are symmetrically distributed respectively along longitudinal central lines and transversal central lines of the mounting holes.

According to the streamlined wavy fin for finned tube heat exchangers as described above, the annular bosses for limiting spacing between the streamlined wavy fins are provided along the edges at one side of the mounting holes, a folded edge is folded outwards on the top of each annular boss.

According to the streamlined wavy fin for finned tube heat exchangers as described above, the maximum amplitude of the convex ripple and the concave ripple is 1/10 to 9/10 of the height of the annular bosses.

According to the streamlined wavy fin for finned tube heat exchangers as described above; the mounting holes are circular holes or elliptical holes.

According to the streamlined wavy fin for finned tube heat exchangers as described above, the surfaces of the convex ripple and the concave ripple are smooth surfaces.

The present invention has the following features and advantages over the prior art.

In the present invention, by continuous guiding of the streamlined convex ripples and concave ripples on the fin surfaces, the fluid flow in the airflow channels mainly flows in the streamlined channels formed by the convex ripples and concave ripples, then the fluid flow is stable, and is more uniformly distributed, thereby efficiently suppressing the flow separation at tails of the circular tubes/elliptical tubes, and obviously reducing the pressure loss of fluid flow. And at the same time, the convex ripples and the concave ripples increase surface areas of the fins, which decreases heat transfer resistance on the fin sides, the streamlined fluid flow makes that it is not easy to producing a recirculation flow region downstream the circular tubes, and heat transfer performance of the fins at the rear part of the tubes may be obviously improved. These entire make the present invention have better fluid flow and heat transfer performances, the fins are not easy to accumulate dust in use, and the stability of the heat transfer performance is maintained.

BRIEF DESCRIPTION OF THE DRAWINGS

The drawings are described herein to only interpret the object, and are not intended to in any way limit the scope disclosed by the present invention. Furthermore, the shapes and scales of the parts in the drawings are illustrative only, which are used to help understand the present invention, but are not to particularly limit the shapes and scales of the parts of the present invention. With the teaching of the present invention, those skilled in the art may select various shapes and scales as demanded to carry out the present invention.

DESCRIPTION OF THE REFERENCE NUMBERS

1. fin body;
2. mounting hole (circular hole or elliptical hole);
3. airflow inlet;
4. airflow outlet;
5. connection line of the wave crests of convex ripple;
6. connection line of the wave troughs of concave ripple;
7. ripple shape;
8. boundaries of a ripple area;
9. annular boss;
10. folded edge;
11. convex ripple;
12. concave ripple.
13. central cross section.
14. plain fins.

DETAILED DESCRIPTION OF THE INVENTION

Details of the present invention shall be clearly understood with reference to the accompanying drawings and the description of the particular embodiments of the present invention. However, the particular embodiments of the present invention described herein are only for explaining the object of the present invention, but not in any way for limiting the present invention. With the teaching of the present invention, those skilled in the art may conceive any possible variations based on the present invention, which are all deemed as being within the scope of the present invention.

FIGS. 1-5 are schematic diagrams of Embodiment 1 of the streamlined wavy fin for a finned tube heat exchanger of the present invention.

Figure 1:
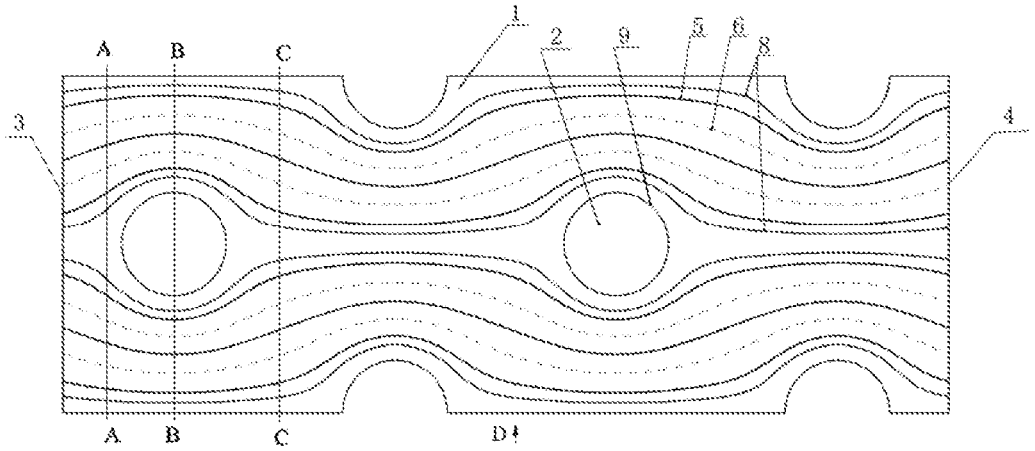
FIG. 1 is a schematic diagram of a planar structure of Embodiment 1 of the streamlined wavy fin for a finned tube heat exchanger of the present invention.
Figures 2, 3, 4:
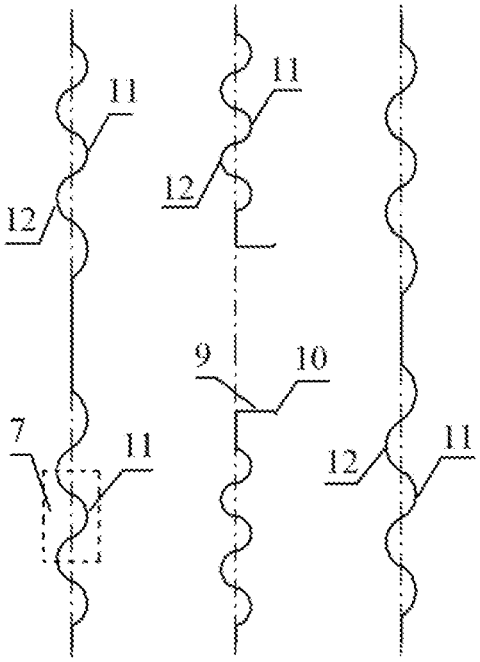
FIG. 2 is a sectional view taking along a line A-A in FIG. 1.
FIG. 3 is a sectional view taking along a line B-B in FIG. 1.
FIG. 4 is a sectional view taking along a line C-C in FIG. 1.
Figure 5:
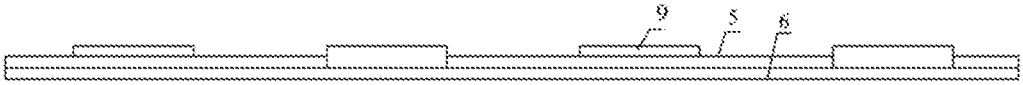
FIG. 5 is a side view in the direction of D in FIG. 1.
Figure 6:
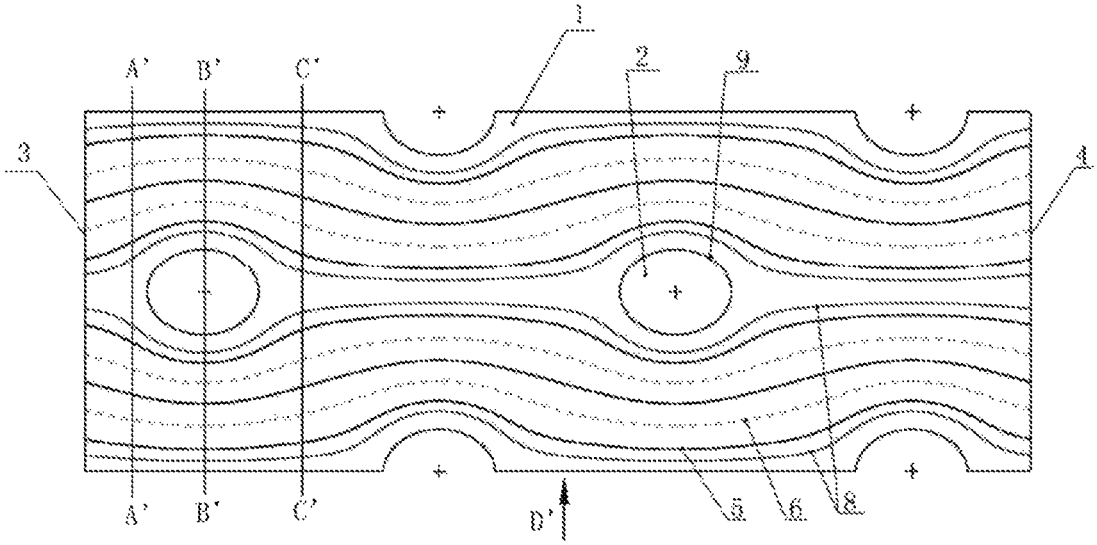
FIG. 6 is a schematic diagram of a planar structure of Embodiment 2 of the streamlined wavy fin for a finned tube heat exchanger of the present invention.
Figures 7, 8, 9:
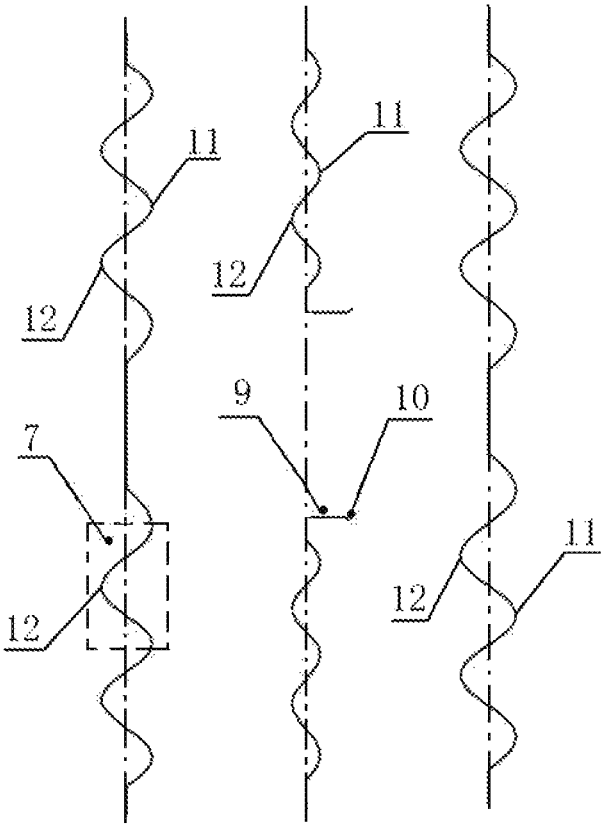
FIG. 7 is a sectional view taking along a line A'-A' in FIG. 6.
FIG. 8 is a sectional view taking along a line B'-B' in FIG. 6.
FIG. 9 is a sectional view taking along a line C'-C' in FIG. 6.
Figure 10:
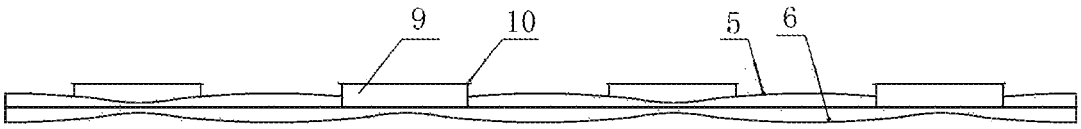
FIG. 10 is a side view in the direction of D' in FIG. 6.
Figure 11:
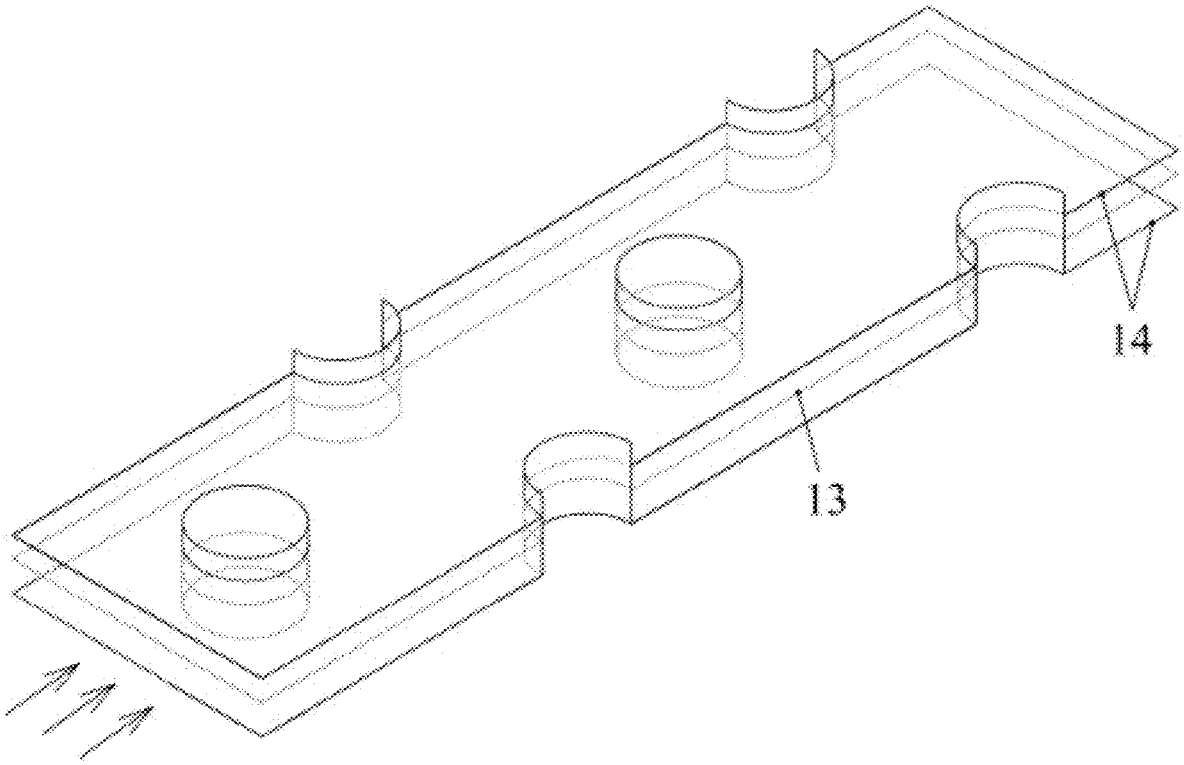
FIG. 11 is a perspective view of the tube-bank plain fin heat exchanger.

As shown in FIG. 1, the streamlined wavy fin for a finned tube heat exchanger of the present invention includes a fin body 1, airflow inlet 3 on one end of the fin body 1, an airflow outlet 4 on the other end of the fine body, and mounting holes 2 for mounting tubes in the fin body 1. In this embodiment, the mounting holes 2 are circular tube holes, and multiple streamlined wavy fins are alternatively stacked. The circular tubes axially pass through the mounting holes 2 of the streamlined wavy fin, and the multiple streamlined wavy fins are fixed on the circular tubes in turn, forming the heat exchanger. Airflow channels are formed between two neighboring streamlined wavy fins. Several convex ripple 11 and concave ripple 12 are consecutively formed by stamping means from the airflow inlet 3 to the airflow outlet 4 on the fin body 1 in the orientation of airflow streamlines, a connection line of the wave crests 5 of the one same convex ripple 11 (as shown in FIG. 2) and a connection line of the wave troughs 6 of the one same concave ripple 12 (as shown in FIG. 7) in neighbor of a convex ripple are both streamlines, thereby guiding channels on the surface of the fin body 1 in the same orientation as the airflow streamlines are formed, which guides the fluid flow to flow along pre-specified streamlines, hence, flow separation is suppressed, pressure loss of flow is decreased, heat transfer performance of the fins is improved, and heat transfer performance is maintained stable.

The streamlines are such streamlines that on the central cross section 13 of the channel formed by the tube-bank-plain fin corresponding to the fin body 1 no recirculation flow appears in the region of the tube tails. The tube-bank-plain fin heat exchanger corresponding to the fin body 1 refers to the finned tube heat exchanger having plain fins 14 in shape of the same fin configuration that the convex ripple 11 and the concave ripple 12 are not processed. The channel formed by the tube-bank-plain fins 14 refer to the channel formed between two neighboring plain fins and the circular tubes passing through the mounting holes. The central cross section 13 of the channel formed by the tube-bank-plain fin heat exchanger refers to the cross section of the fin side channel, which is perpendicular to the axial directions of the circular tubes, and have the same distance to two fins 14 forming the channel. The tube tail refers to a small region beside the tube, which relates to the airflow direction and locates downstream the tube.

In the present invention, the streamlines are related to a particular structure of the heat exchanger, which may be obtained by those skilled in the art using an existing numerical method, and shall not be described herein any further. And the streamlines that on the central cross section 13 of the channel formed by the tube-bank-plain fin 14 corresponding to the fin body 1 no recirculation flow appears in the region of the tube tails may be obtained by those skilled in the art using a calculation method and limited number of trial calculations.

Furthermore, the space between the connection line of the wave crests 5 of the convex ripple and the connection line of the wave troughs 6 of the neighboring concave ripple or the number of the convex ripples and concave ripples is determined according to stream function values of the boundaries of the ripple area as demanded. In the present invention, according to positions of the mounting holes 2, the boundaries 8 of the ripple area are located at upper and lower sides of the mounting holes 2, the convex ripple 11 and the concave ripple 12 locates respectively within the boundaries 8 of the ripple area, and the upper and the lower boundaries 8 of the ripple area are also streamlines and have different stream function values, the stream function values of the boundaries of the ripple area are determined as demanded, and the space between the connection line of the wave crests 5 of the convex ripple and the connection line of the wave troughs 6 of the concave ripple or the number of the convex ripple and concave ripple is determined according to the stream function values of the boundaries 8 of the ripple area as demanded. Wherein, the prior art may be referred to a method for calculating the stream function values, which shall not be described herein any further.

As shown in FIGS. 2-4, in this embodiment, the cross sections of the convex ripple 11 and the concave ripple 12 are in a consecutive sinusoidal shape, and the blocks in dotted lines in FIGS. 2 and 7 respectively denote wave shapes 7 of the convex ripple 11 and the concave ripple 12. However, the present invention is not limited thereto, and the cross sections of the convex ripple 11 and the concave ripple 12 may also be in folded line shapes, parabolic line shapes, or arc line shapes, or any other suitable shapes, only if they are appropriate to guide fluid flow.

Furthermore, the amplitude of the convex ripple and the amplitude of the concave ripple may be fixed values, and may also be variable values, that is, the amplitude of the convex ripple and the amplitude of the concave ripple are distributed along the longitudinal direction (the longitudinal direction is the direction from the airflow inlet 3 to the airflow outlet 4) in a form of wavy profile.

As a preferred embodiment of the present invention, the change of the amplitude of the convex ripple and the change of the amplitude of the concave ripple may be designed contrary to the change of the airflow velocity when airflow passes through the wavy fin, that is, the amplitude is decreased in a zone where the airflow velocity is large, and is increased in a zone where the airflow velocity is small. Hence, the tangential stress produced by fluid flow on the wall surfaces of the wavy fin may be decreased. As the stress is a main factor causing flow resistance, this may function to decrease the flow resistance.

Furthermore, the amplitude of the convex ripple 11 and the amplitude of the concave ripple 12 are the same value or variable value to each other in the transversal direction (i.e. the direction perpendicular to the main flow direction). And this may be selected by those skilled in the art according to an actual situation.

As a preferred embodiment of the present invention, the amplitude of the convex ripple and the amplitude of the concave ripple may be designed as that the amplitude of the convex ripple and the concave ripple may be respectively increased at a position away from the mounting holes, and decreased at a position near the mounting holes. Hence, the tangential stress produced by fluid flow on the wall surfaces of the wavy fin may be decreased, and this may function to decrease the flow resistance further.

As shown in FIG. 1, after the boundaries 8 of the ripple area being determined, the convex ripple 11 and the concave ripple 12 are alternatively distributed as demanded between the boundaries 8 of the ripple area, and are symmetrically distributed along longitudinal central lines and transversal central lines of the mounting holes 2, wherein, the longitudinal central lines refer to straight lines passing through the mounting holes 2 from the left to the right in FIG. 1, and the transversal central lines refer to straight lines passing through the mounting holes 2 from the lower to the upper in FIG. 1, thereby making the flow velocity be relatively uniform, reducing pressure loss of flow, and improving heat transfer performance of the fins.

As shown in FIG. 1, multiple mounting holes 2 are provided in the fin body 1, which may be provided in a inline manner, that is, the central points of the multiple mounting holes 2 are in the same longitudinal central line, or may be provided in a staggered manner, that is, the central points of the multiple mounting holes 2 are not in the same longitudinal central line. Annular bosses 9 are provided along edges at one side of the mounting holes 2, and when the wavy fin and the circular tubes are mounted, the protruding annular boss 9 of a latter wavy fin presses against the back of a former wavy fin, thereby limiting spacing between the streamlined wavy fins in neighbor, and achieving a goal of positioning the fins.

As shown in FIG. 3, a folded edge is folded outwards from the top of the annular boss 9, so as to facilitate mounting the tubes and to determine the spacing between the fins. In the present invention, the height of the annular bosses 9 may be in different sizes according to the change of the spacing between the fins. And in mounting process, after expanding of the tubes or welding between the annular bosses 9 and the tubes, the annular bosses 9 tightly contact with tubes, so as to function to fix the wavy fin and reduce heat transfer resistance.

Furthermore, the maximum amplitude of the convex ripple 11 and the concave ripple 12 is 1/10 to 9/10 of the spacing between the fins (i.e. the height of the annular bosses).

Furthermore, the surfaces of the convex ripple 11 and the concave ripple 12 are smooth surfaces, and combined with the streamlined structure of the convex ripple 11 and the concave ripple 12, dust is not easy to be accumulated in use, heat transfer resistance on the fin side is further reduced, and heat transfer performance of the fins are improved.

FIGS. 6-10 are schematic diagrams of Embodiment 2 of the streamlined wavy fin for a finned tube heat exchanger of the present invention. A structure and functions of this embodiment are substantially the same as those of Embodiment 1, with an exception that the mounting holes 2 used in this embodiment are elliptical holes, so as to be suitable for the tube with cross sections in elliptical shapes.

After being formed by punching, the streamlined wavy fins in the present invention are nested on the circular tubes or the elliptical tubes, and are positioned by the annular bosses 9 with folded edges 10. And manufacture of the finned tube heat exchangers is completed in a series of processes, such as expansion/welding of the tubes, and leakage check of in-tube pressure trial, etc.

The operational principle of the streamlined wavy fin of the present invention is: when fluid (airflow) flows in the airflow channels between the streamlined wavy fins, continuously led by the streamlined the convex ripple 11 and the concave ripple 12 on the surfaces of the fins, part of airflow flows in the streamlined channels formed by the convex ripple 11 and the concave ripple 12, thereby making the flow stable, the airflow velocity relatively uniform, which efficiently suppresses the flow separation at the tails of the circular tubes/elliptical tubes (the tube tail refers to a small region beside the tube, which relates to the airflow direction and locates downstream the tube), and obviously reduces the pressure loss of airflow. And at the same time, the convex ripple 11 and the concave ripple 12 increase the surface area of the fins, then decrease heat transfer resistance on the fin side, the streamlined fluid flow makes that the recirculation flow is not easy to be produced downstream the tubes, and the heat transfer performance of the fins in the region downstream the tubes is outstandingly improved. The present invention makes the streamlined wavy fins have better fluid flow and heat transfer performances, the fins not easy to accumulate dust in use, which maintains stability of the heat transfer performance.

An object of the detailed description of the above embodiments is only to interpret the present invention, so that the present invention is understood better. However, such description should not be in any way interpreted as limiting the present invention. Especially, the features described in various embodiments may also be arbitrarily combined, so as to constitute other embodiments. Unless otherwise specified, these features should be understood as being applicable to any one of the embodiments, rather than being limited to the described embodiments.

What is claimed is:

1. A streamlined wavy fin for a tube-bank plain fin exchanger, comprising:

a fin body, an airflow inlet on one end of the fin body, an airflow outlet on the other end of the fin body, and mounting holes for mounting tubes in the fin body, wherein a plurality of convex ripples and concave ripples are each continuously formed from the airflow inlet to the airflow outlet within a rippled area on the fin body in an orientation of pre-specified streamlines of a flow through the tube-bank plain fin heat exchanger from the airflow inlet to the airflow outlet, the convex ripples being convex with respect to a direction of the tubes, the concave ripples being concave with respect to the direction of the tubes;

the convex ripples and the concave ripples are provided within the boundaries of a ripple area set on the fin body, the boundaries of the ripple area located at the upper and lower sides of the mounting holes are all defined by the pre-specified streamlines, and are determined according to stream function values;

all wave crests of the convex ripples and all wave troughs of the concave ripples are oriented such that the wave crests and the wave troughs follow the pre-specified streamlines, and are each continuously formed from the airflow inlet to the airflow outlet such that air passing over a surface on one side of the fin body does not pass over a surface on an opposite side of the streamline;

a distance between one of the wave crests and one of the adjacent wave troughs or a total number of the wave crests and the wave troughs is determined according to the stream function values used to determine the boundary lines of the rippled area;

the pre-specified streamlines are streamlines in a flow around the tubes through a tube-bank plain fin heat exchanger from the airflow inlet to the air flow outlet, the tube-bank plain fin heat exchanger including tubes having a same diameter as the fin body, and plain fins having a same longitudinal tube spacing and traverse tube spacing as the fin body;

the pre-specified streamlines are streamlines obtained on a center cross section of the tube-bank plain fin heat exchanger, such that when airflow passes the tubes, the airflow passes without flow recirculation at tube tails.

2. The streamlined wavy fin, according to claim 1, wherein cross sections of the convex ripples and the concave ripples are in shapes of folded line, sinusoidal line, parabolic line, or arc line.

3. The streamlined wavy fin, according to claim 1, wherein the amplitude of each of the convex ripples and the amplitude of each of the concave ripples have a constant value.

4. The streamlined wavy fin, according to claim 1, wherein the amplitude of the convex ripples and the amplitude of the concave ripples are distributed in the longitudinal direction with a wavy profile.

5. The streamlined wavy fin, according to claim 4, wherein the amplitude of the convex ripples and the amplitude of the concave ripples are decreased in a zone near the tube where the velocity of the airflow is large, and are increased in a zone away from the tube where the velocity of the airflow is small.

6. The streamlined wavy fin according to claim 1, wherein the amplitude of the convex ripples and the amplitude of the concave ripples are the same and uniformly distributed along the transverse direction.

7. The streamlined wavy fin, according to claim 1, wherein the amplitude of the convex ripples and the amplitude of the concave ripples are not the same and not uniformly distributed along the transverse direction.

8. The streamlined wavy fin, according to claim 1, wherein the amplitude of the convex ripples and the amplitude of the concave ripples are increased at the position away from the mounting holes, and decreased at the position near the mounting holes, respectively.

9. The streamlined wavy fin, according to claim 1, wherein the convex ripples and the concave ripples are symmetrically distributed along the longitudinal central lines and the transverse central lines of the mounting holes, respectively.

10. The streamlined wavy fin, according to claim 1, wherein the geometry shapes of the cross section of each of the tubes are circular or elliptical tubes.

11. The streamlined wavy fin, according to claim 1, wherein annular bosses for determining the spacing between the streamlined wavy fins are provided along the edge at one side of the mounting hole, where a folded edge is folded outwards on the top of the annular bosses.

12. The streamlined wavy fin, according to claim 1, wherein the maximum amplitude of the convex ripples and the concave ripples is 1/10 to 9/10 of the height of annular bosses.

13. The streamlined wavy fin, according to claim 1, wherein the mounting holes are circular holes or elliptical holes.

14. The streamlined wavy fin, according to claim 1, wherein the surfaces of the convex ripples and the concave ripples are smooth surfaces.

* * * * *